US005176283A

United States Patent [19]

Patterson et al.

[11] Patent Number: 5,176,283

[45] Date of Patent: Jan. 5, 1993

[54] PLATE-AND-GLASS ASSEMBLIES

[76] Inventors: Ronald Patterson, 11 Bd Albert-er, Monte-Carlo, Monaco; John W. Patterson, 20819 - 229th Ave. SE., Maple Valley, WA 98038

[21] Appl. No.: 832,436

[22] Filed: Feb. 7, 1992

[51] Int. Cl.[5] ..... B65D 21/02

[52] U.S. Cl. ..... 220/574; 220/23.86; 206/217; 206/541

[58] Field of Search ..... 220/574, 23.83, 23.86; 206/217, 541

[56] References Cited

U.S. PATENT DOCUMENTS

| | | | |
|---|---|---|---|
| D. 211,532 | 6/1968 | Ashton . | |
| 1,187,899 | 6/1916 | Gardam | 220/23.86 |
| 1,688,992 | 10/1928 | Smith . | |
| 2,240,020 | 4/1941 | Raiser . | |
| 2,565,912 | 8/1951 | Davis . | |
| 2,920,804 | 1/1960 | Minton . | |
| 3,955,672 | 5/1976 | Brundage | 220/23.86 X |
| 4,461,396 | 7/1984 | Harper . | |
| 4,534,469 | 8/1985 | Elsmo | 206/217 X |
| 4,823,958 | 4/1989 | Mahmud | 220/23.83 |
| 4,867,331 | 9/1989 | Task | 220/23.83 |
| 4,927,024 | 5/1990 | Lloyd | 220/23.86 |
| 4,938,373 | 7/1990 | McKee | 220/23.86 |
| 4,989,742 | 2/1991 | Powell | 220/23.83 X |
| 5,058,737 | 10/1991 | Patterson et al. | 220/23.86 X |
| 5,060,820 | 10/1991 | Boerner | 220/23.83 X |
| 5,085,391 | 2/1992 | Berger et al. | 220/23.83 X |
| 5,110,170 | 5/1992 | Boatwright | 220/23.83 X |

FOREIGN PATENT DOCUMENTS

| | | | |
|---|---|---|---|
| 978565 | 12/1964 | United Kingdom | 220/23.83 |

*Primary Examiner*—Steven M. Pollard

[57] ABSTRACT

Plate-and-glass assemblies which include a plate, a glass detachably assembled to the plate, and a separated fabricated glass holder which is subsequently attached to the bottom of the plate to hold that component and the glass together. Indicia on the upper, food-receiving surface of the plate facilitate the assembling of the glass to the plate; and an optional drinking straw port provides a convenient way of locking the plate and glass together and also makes it possible to reach the contents of the glass without removing the plate.

22 Claims, 3 Drawing Sheets

PLATE-AND-GLASS ASSEMBLIES

TECHNICAL FIELD OF THE INVENTION

The present invention relates to plates and glasses for serving food and drink. More particularly, the present invention relates to novel, improved assemblies of a plate and a glass which is attachable to the plate to form a unit which can be handled with one hand and to components for such assemblies.

The terms "plate" and "glass" are employed herein in a broad, generic sense. The term "plate" is intended to embrace such diverse artifacts as individual eating dishes and different types of serving dishes. "Glass" encompasses containers conventionally named by that term, beverage and soup cups, etc.

BACKGROUND OF THE INVENTION

A number of situations exist in which the use of conventional plates and glasses is difficult. For example, at parties, picnics, and other social gatherings, guests are often obligated to stand or walk about while eating and drinking. Inevitably, they are forced to hold their plate in one hand and their glass in the other. This does not leave free a hand with which to eat. Therefore, the guest must first seek out a resting place for at least the glass. Not only is this inconvenient, but the availability of suitable resting places is frequently quite limited at a social gathering. Furthermore, a guest may be unable to subsequently identify his drink and may recover someone else's drink by mistake. It is also frequently difficult to carry a separate plate and glass through a buffet line or when returning to one's seat at a sporting event or movie theater.

Several different assemblies for eliminating the need to use both hands to carry a plate and a glass have been proposed. One such assembly is shown in U.S. Pat. No. 2,240,020 issued Apr. 29, 1941 to Raiser. That assembly includes a plate having a central aperture for a cup and a hollow handle which extends downwardly from the cup-receiving receptacle. Although this device permits one to carry both the plate and cup with one hand, the cup is not actually attached to the plate and is thus easily dislodged or overturned. Furthermore, liquid can readily slosh over the open top of the cup and onto the food. Still further, the food on the plate can easily come into contact with and foul the exterior of the drinking cup; and food may slosh through the opening in the plate and pass through the hollow handle onto an underlying table or lap.

U.S. Pat. No. 2,920,804 issued Jan. 12, 1960 to Minton discloses a somewhat similar assembly in which a hollow sleeve forms a receptacle for a glass. This sleeve is joined to a plate component by a bead which releasably engages a flange on the plate. U.S. Pat. No. 211,532 issued Jun. 25, 1968, to Ashton discloses a serving tray having an overall configuration very similar to that of Minton. U.S. Pat. No. 3,955,672 issued May 11, 1976, to Brundage discloses another plate having a hole in which an open cup is set. In this case, the plate has a channel for balancing the plate on the user's forearm while he grasps the lower end of the cup.

U.S. Pat. No. 4,461,396 issued Jul. 24, 1984, to Harper discloses a plate having a recess for the lower end of a glass in its upper surface. The user's thumb protrudes upwardly through a hole in the plate and presses against the base of the glass to retain it in the recess. This arrangement shares disadvantages with the devices disclosed in the patents cited above. Since the glass is not attached to the plate, momentary relief of the thumb pressure may allow the glass to become dislodged; the drink can easily slosh out of the glass and onto the food; the food can slosh through the hole in the plate; and the food contained on the plate can easily get on the outside of the glass.

U.S. Pat. No. 1,688,992 issued Oct. 23, 1928, to Smith discloses a cup and saucer combination in which the saucer may either support or cover the cup without sliding about. However, the cup and saucer are not attached to each other. U.S. Pat. No. 2,565,912 issued Aug. 28, 1951, to Davis discloses a watercolor paint set in which the palette has a center portion that rests in the mouth of a water container. As the components of these units are not attached to each other, the units have the same disadvantages as Minton's and those of similar character.

The foregoing and other problems appurtenant to the patented arrangements are resolved by the novel plate-and-glass assemblies disclosed in U.S. Pat. No. 5,058,737 issued 22 Oct. 1991 to Patterson et al. These assemblies are made up of: (a) a plate with a generally horizontal upper surface for supporting food, a lower surface, and a peripheral rim; (b) at least one glass for holding a drink, the glass having an open upper end which forms a mouth; and (c) cooperating connector components for so detachably securing the mouth of the glass to the lower surface of the plate that the mouth of the glass is covered by the plate and the glass is positioned in an upright orientation when the plate is positioned to support food. In the patented, Patterson et al. plate-and-glass assemblies, the plate-associated connector component—herein designated a "holder" or "glass holder"—is an integral part of the plate with which it is associated.

SUMMARY OF THE INVENTION

It has now been found that an integrally formed glass holder is not required and that one can instead often employ to advantage a holder fabricated as a separate component and subsequently attached to a plate as with an appropriate adhesive, by thermal or ultrasonic welding, or by any other technique provision of a separately fabricated glass holder appropriate for a particular application of the invention. This provision of a separately fabricated glass holder makes it possible to provide plate-and-glass assemblies which: (1) have the advantages of those disclosed in the '037 patent, but (2) do not require the specially designed plate-with-holder components of the latter. Instead, the novel glass holders disclosed in allow one to use conventional plates—including inexpensive, paper and plastic, disposable plates—in the plate-and-glass assembly. This has the advantage that the plate and attached holder may be produced cheap enough to allow them to be disposed of after being used which may not be true of the integrated plate-and-holder component. Also, the separate, attachable holder allows the plate to be made of cellulosic and other materials which would perhaps be impractical if the integrated plate-and-glass holder approach disclosed in the '737 patent were employed. Also, the separately fabricated holder gives plate manufacturers an inexpensive entree into the plate-and-glass assembly field.

The separate, attachable glass holder can be fabricated from a variety of materials including thermoplastic polymers and cellulosic fiber pulps. Injection and other conventional molding techniques can be employed to form the novel glass holders disclosed herein from thermoplastic polymers. Approaches such as those used to manufacture egg cartons, etc. can be utilized to make those holders from cellulosic pulps.

In one plate-and-glass assembly disclosed in the '737 patent, the integral glass holder has a generally circular shape, is spaced from the lower surface of the plate, and cooperates with the plate to define a generally U-shaped channel which: (1) has a widened, assembly facilitating mouth, (2) and is bounded by a glass-retaining lip or flange. The channel has an open end proximate the rim of the plate to which the holder is attached and a closed end proximate the central portion of the plate. The U-shaped channel is configured to so receive the upper end of the glass that the glass is slidable in the channel from its open end to its closed end. A conventionally present, radial lip or rim at the upper end of the glass is trapped between the peripheral lip of the holder and the bottom of the plate and detachably couples the glass to the plate as the glass is slid into the channel.

A separate and attachable glass holder as disclosed herein will typically have the circular configuration; U-shaped, widened mouth channel; and glass trapping lip of the integral holders disclosed in the '737 application. Also, a boss spaced inwardly from and extending around the periphery of the holder from one side to the other of the U-shaped groove will typically be provided. This contributes structural rigidity and has been found to contribute significantly to the stability of a filled plate employed without or subsequently separated from a glass and placed on a supporting surface.

Also, it has been found that there are a number of novel and unobvious features which can be incorporated to advantage in plates designed for plate-and-glass assemblies of the character disclosed herein, whether or not they are intended to be disposable, and that these features can be incorporated to equal advantage in the plates of those assemblies disclosed in the '737 patent.

Specifically, once a plate has been filled, it may prove difficult to manipulate the plate so that the opening of the glass-receiving channel can be seen and the glass started through that channel without spilling food from the plate. In accord with the principles of the present invention, this problem is solved in a simple and elegant fashion by placing on the upper surface of the plate indicia showing the location of the channel's mouth and, if desired, the direction in which the glass is to be displaced to lock it to the plate. Such indicia may be incorporated in, or constitute, an aesthetically pleasing design on the plate's upper surface.

Another, also optional but advantageous, innovation is the inclusion of a straw port in plates destined for a plate-and-glass assembly of the character disclosed herein or in the '737 patent. The straw port allows one to reach liquid in a glass assembled to the plate without removing the glass. Also, a straw extending through the port into the glass locks the plate to the glass. That keeps the glass from sliding down the integral or separately fabricated glass holder, separating from the plate, and perhaps spilling its contents if the plate is tipped in a direction which might otherwise allow the just-described mishap to occur.

The objects, features, and advantages of the present invention will be apparent to the reader from the foregoing and the appended claims and as the ensuing detailed description and discussion proceeds in conjunction with the accompanying drawings.

DETAILED DESCRIPTION OF THE INVENTION

Figure 1:
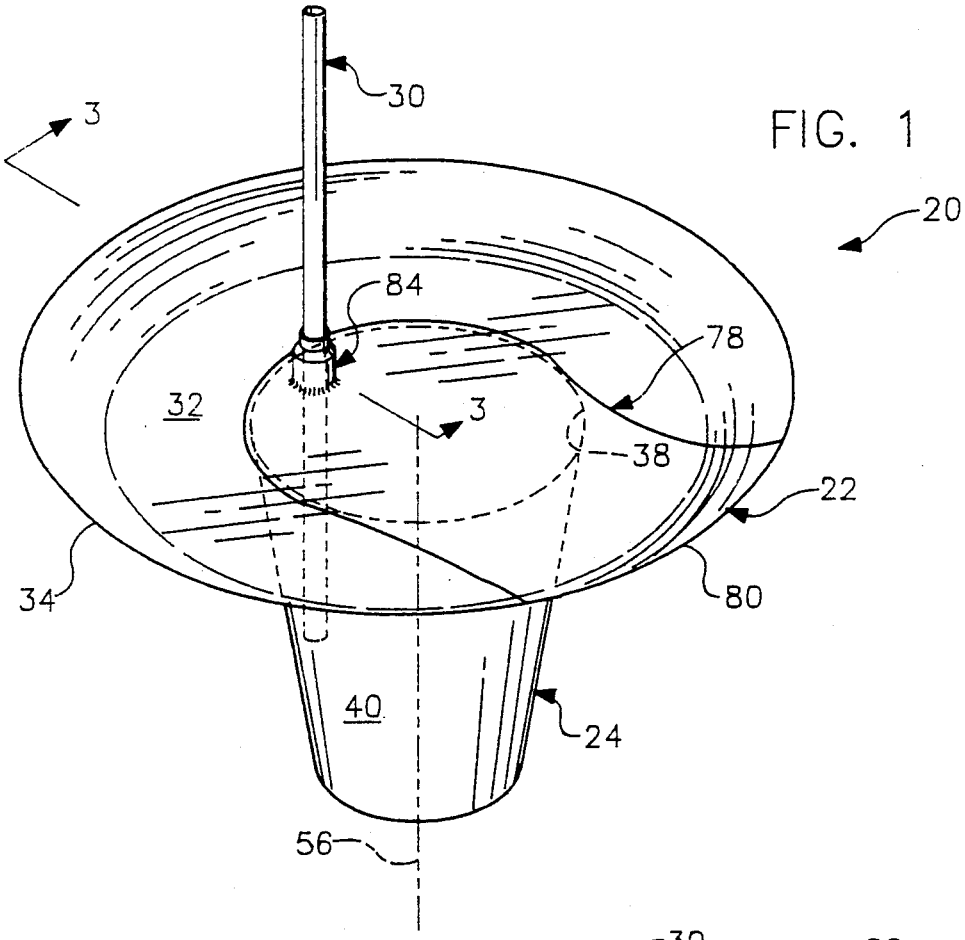
FIG. 1 is a perspective view, looking down on a plate-and-glass assembly employing a separately fabricated glass holder in accord with the principles of the present invention.

Referring now to the drawing, reference character 20 identifies a plate-and-glass assembly constructed in accord with, and employing the principles of the present invention. The components of assembly 20 are: a plate 22; a glass 24; a separately fabricated glass holder 26 which is attached to the bottom 28 of plate 22 and cooperates with the plate to detachably couple the glass to it; and an optionally employable drinking straw 30 for locking the assembled plate 22 and glass 24 together.

Plate 22 may or may not be of the disposable type, and it may be fabricated from such diverse materials as synthetic polymers, porcelains and glasses, metals, and cellulosic materials such as the heavier grades of paper.

The illustrated, exemplary plate 22 has: (1) a horizontally orientable, upper, food-receiving surface 32 surrounded by an arcuate, upwardly directed rim 34 which keeps food from sliding off the plate, and (2) the aforementioned lower side or bottom 28 which is flat and therefore affords some stability when plate 22 is placed on a supporting surface.

The glass 24 assembled to plate 22 in plate-and-glass assembly 20 is of equally conventional construction and can similarly be fabricated from a wide variety of materials including those identified above. This illustrated, exemplary glass 22 has a frustoconical configuration with a closed bottom 36 at one end and an open mouth 38 of somewhat larger diameter at the other. Surrounding the frustoconical wall 40 of the cup at mouth 38 is a radially and outwardly extending, turned down, integral rim or lip 42.

The separately fabricated glass holder 26 may be fabricated from the same types of materials as plate 22 and 24 with components of that character ejection or otherwise molded from a thermoplastic polymer and those fabricated from a cellulosic pulp by the forming technique employed for egg cartons and comparable artifacts typically being preferred because they are inexpensively and easily manufactured. The glass holder and plate can also be made from different materials. For example, a plastic glass holder may be used with a paper plate to strengthen the unit and to ensure that the glass holder will not deform under the weight of a glass and its contents and allow the glass to come free from the plate.

Figure 2:
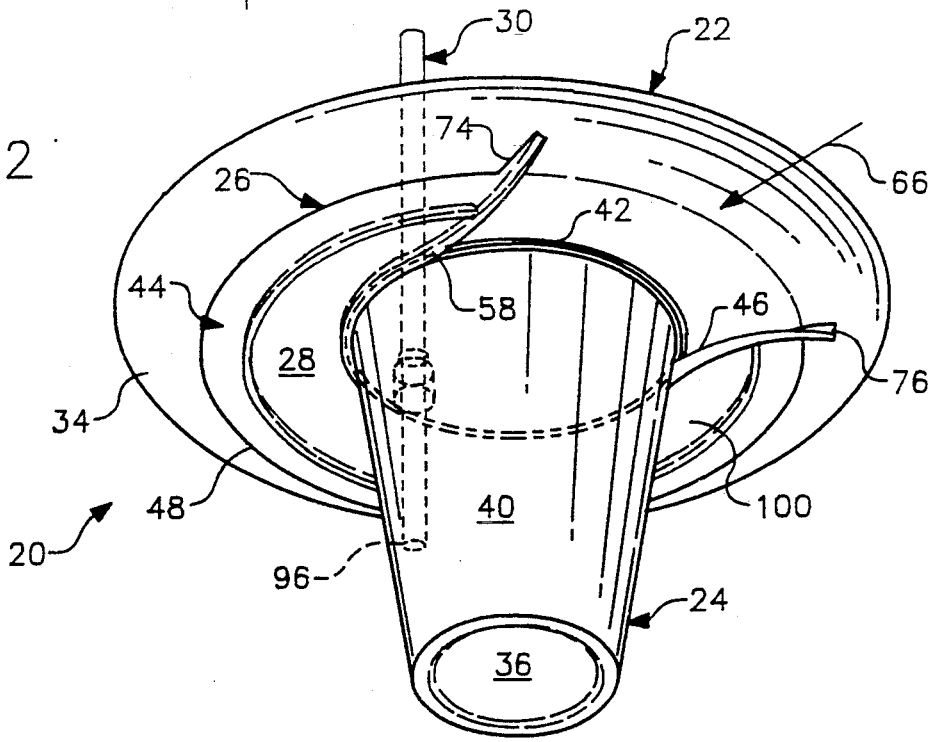
FIG. 2 is a perspective view, looking up toward the plate-and-glass assembly of FIG. 1.

The illustrated, exemplary glass holder 26 is a component with a flat main body portion 44 of a circular configuration and with a diameter approximating that of the flat bottom 28 of the plate 22 to which it is attached in plate-and-glass assembly 20. Incorporated in glass holder 26 is a generally U-shaped slot 46 along which glass 24 is rectilinearly displaced in the course of assembling the glass to the companion plate 22 in plate-and-glass assembly 20. This slot extends radially inward from the periphery 48 of glass holder 26, terminating in a semicircular closed end 50 so located that its center 52 is coincident with: (a) the center 54 of plate 22, and (b) the axis of symmetry 56 of glass 24 when the plate and glass are assembled together as shown in FIGS. 1 and 2. By thus centering plate 22 on glass 24, maximum stability is imparted to plate-and-glass assembly 20.

Figure 3:
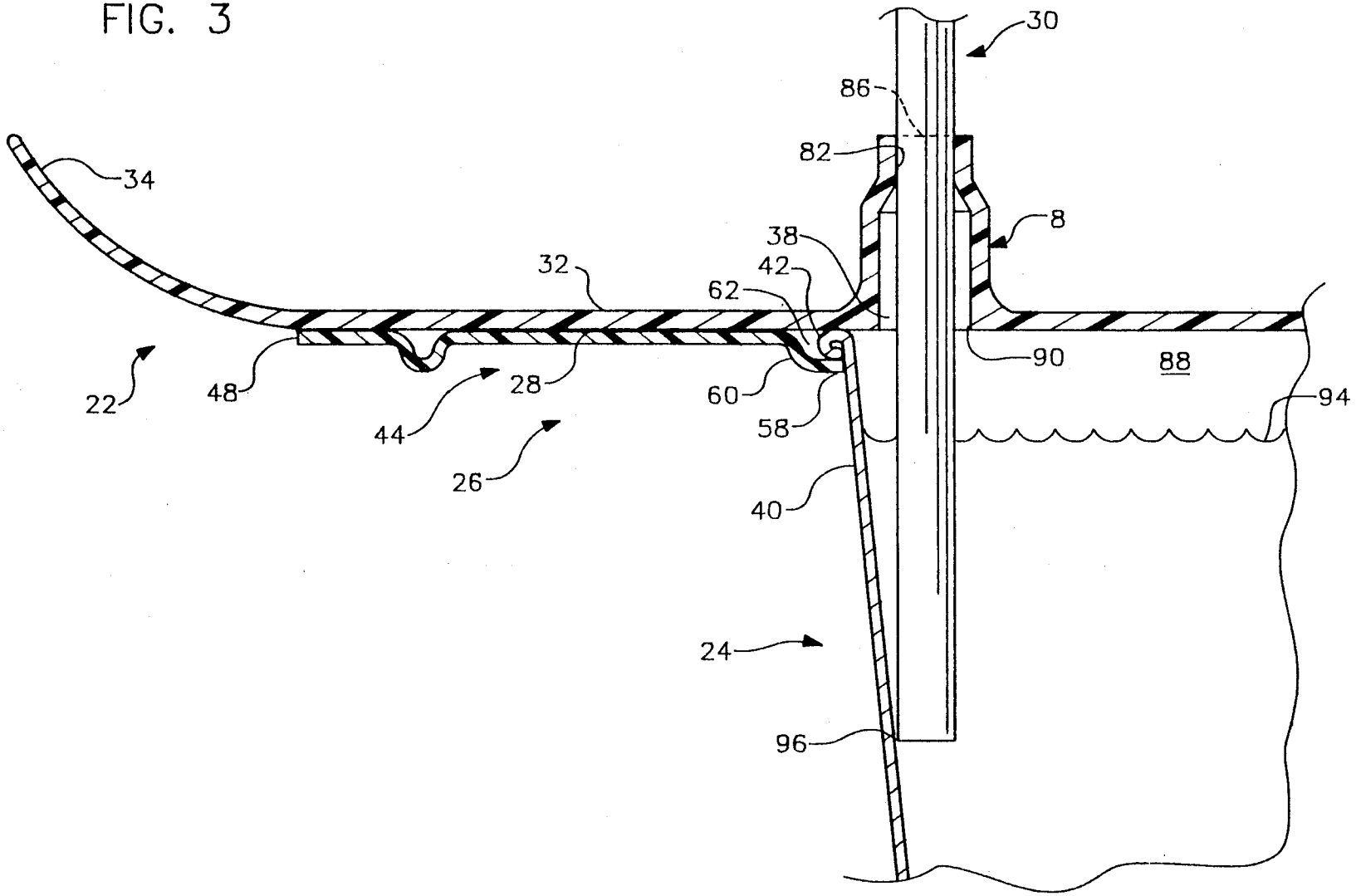
FIG. 3 is a section through FIG. 1, taken substantially along line 3—3 of the latter figure.
Figure 4:
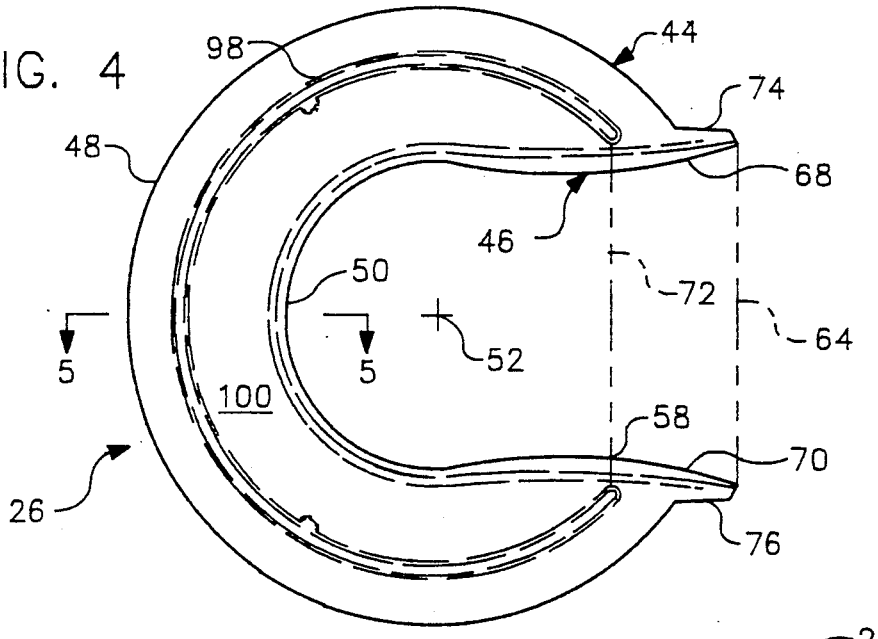
FIG. 4 is a bottom view of a separately fabricated glass holder employed in the assembly of FIG. 1.

As is perhaps best shown in FIG. 4, the U-shaped slot 46 of glass holder 26 is bounded by a lip or flange 58 which parallels the main body portion 44 of the glass holder and is joined to that main body portion by an integral connecting segment 60. With glass holder 26 attached to the bottom 28 of plate 22 as shown in FIG. 3, the just-described glass holder lip 58 and the bottom 28 of plate 22 cooperate to form a channel 62 through which the lip 42 at the mouth 38 of glass 24 can be displaced as glass 24 is assembled to plate 22 by: (1) first positioning the upper end or mouth 38 of the glass at the mouth 64 of U-shaped, glass holder slot 46 and then (2) effecting radial inward movement of the glass relative to the plate as indicated by arrow 66 in FIG. 2. As glass 24 is moved relative to plate 22 in the arrow 66 direction, the slot surrounding lip 58 of glass holder 26 engages the rim or lip 42 at the mouth 38 of glass 24. This traps the glass's lip 42 against the bottom 28 of plate 22 and thereby detachably couples glass 24 to plate 22. This relative, coupling displacement of glass 24 relative to plate 22 is continued until glass 24 reaches, and is stopped by, the closed inner end 50 of glass holder slot 46. As indicated above, this symmetrically positions plate 22 on glass 24, optimally stabilizing plate-and-glass assembly 20.

In the illustrated, exemplary glass holder 26, the sides 68 and 70 of U-shaped slot 46 diverge beginning approximately at the location identified by phantom line 72 in FIG. 4; and they extend somewhat beyond the circular periphery 48 of glass holder main body portion 44 on triangular extensions 74 and 76. This combination of diverging slot sides and extended length glass holder lip facilitates the entry of glass rim 42 into the mouth of the glass holder-to-plate bottom channel 62 and the subsequent rectilinear displacement of glass 24 in the plate-and-glass coupling (arrow 66) direction.

In those circumstances in which plate 22 is loaded with food before it and glass 24 are coupled together, some slight difficulty may be experienced in tilting plate 22 so that the mouth 64 of channel 62 can be seen and glass 24 started up the channel without losing food from the plate. In the exemplary plate-and-glass assembly 20 disclosed herein, this problem is solved in a simple, inexpensive, and elegant fashion simply by providing, on the food-receiving, upper surface 28 of plate 22, visual indicia 78 in the form of a generally bell-shaped area contrasting in color with the remainder of surface 22. In the particular arrangement illustrated in FIG. 1, this colored area 78 extends radially inward from the peripheral segment 80 of the indicia identifying the location of channel mouth 62 in the same direction as arrow 66. Consequently, indicia 78 not only allow one to identify the location of channel mouth 62 without tilting plate 22 but, also, make clear the direction in which the glass 24 is to be moved relative to plate 22 to couple the plate and glass together.

The illustrated, solid color indicia 78 are merely exemplary. Various aesthetic patterns, corporate and other logos, etc. may instead be employed as deemed appropriate.

As is shown in FIGS. 1 and 3, a drinking straw port 82 is provided on the upper side of plate 22 of plate-and-glass assembly 20. More specifically, this port is a bore extending from end-to-end through an integral boss 84 which extends upwardly from the food-receiving surface 28 of plate 22 to a level sufficiently far above that of rim 34 to keep food and liquids on the plate from reaching the upper end 86 of drinking straw port 82.

Drinking straw port 82 communicates with the interior 88 of the glass 24 assembled to plate 22 through an aperture 90 in the plate. This allows drinking straw 30 to be inserted into port 82 through the port's upper end 86 and then displaced downwardly through the port into the assembled glass 24. This has two salutary benefits First, it allows the contents 94 of the glass to be accessed without removing glass 24 from plate 22. Also, as is best shown in FIG. 3, the lower end 96 of the installed drinking straw 30 engages the frustoconical side wall 40 of glass 24 as the lower end portion 96 of the straw reaches a level such as that shown in FIG. 3. At this juncture, straw 30 consequently locks glass 24 to plate 22. This is a decided benefit as it keeps glass 24 from decoupling and its contents 94 from being spilled in those circumstances in which plate-and-glass assembly is held by the plate and so tilted that glass 24 might otherwise slide back down channel 62 and come free of plate 22.

To further optimize the utility of plate-and-glass assembly 20, an integral boss 98 with a generally U-shaped cross-section is preferably developed on that same bottom or exposed side 100 of glass holder 26 as glass trapping flange 58. Boss 98 is spaced inwardly from, and is concentric with, the circular periphery 48 of glass holder main body portion 26. In many circumstances, plate 22 is employed without glass 24 or is removed from the glass before comestibles loaded onto it are eaten; and the plate is therefore supported directly on a surface such as that identified by reference character 102 in FIG. 5. In such circumstances, ring-shaped, U-sectioned boss 98 increases the stability of the plate on supporting surface 102 to a level significantly above that which the plate would otherwise have.

Figure 5:
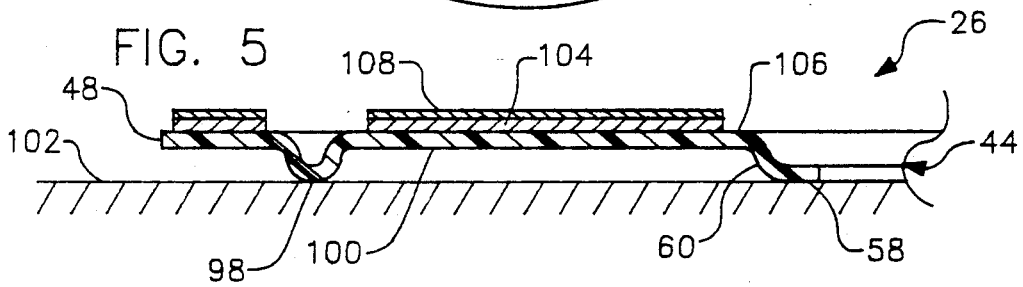
FIG. 5 is a section through the separately fabricated glass holder, taken substantially along line 5—5 of FIG. 4.

The novel glass holder 26 described above may be attached to the bottom 36 of plate 22 in any desired fashion—for example, by thermal bonding or ultrasonic welding. Or, as shown in FIG. 5, a layer 104 of an appropriate, pressure sensitive adhesive may be employed for this purpose. Adhesive layer 104 is formed on the top or interior surface 106 of glass holder main body portion 44 and covered with a conventional, protective peel strip 108. To attach glass holder 26 to plate 22, one simply removes peel strip 108 and then firmly presses glass holder 26 against the bottom 28 of plate 22, allowing the adhesive to form a firm bond between the glass holder and the plate.

Figure 6:
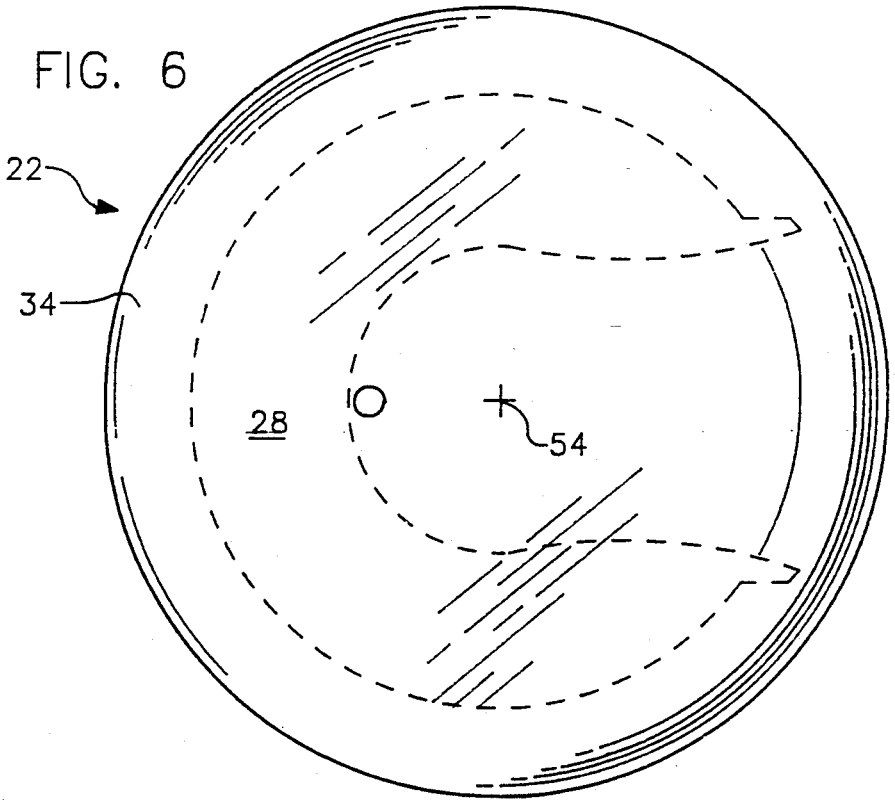
FIG. 6 is a bottom view of the plate, included primarily to show indicia used in attaching the separately fabricated glass holder to the plate in those instances in which this task is carried out manually, for example.

There are circumstances in which it may be advantageous to supply plates destined for a plate-and-glass assembly as disclosed herein and appropriate glass holders separately for later, manual assembly. In these circumstances, it is typically preferable to apply a trace such as that identified by reference character 110 in FIG. 6 to the bottom 28 of the plate 22 with which the glass holder is to be used. Trace 110 has the same configuration as the periphery of glass holder main body portion 44. Consequently, this trace considerably facilitates the accurate placement of the glass holder on plate bottom 28 in the course of assembling the glass holder to the plate.

The provision of a glass holder-locating trace on a plate is of course by no means mandatory. For example, the separately fabricated glass holder 26 may be made or acquired by the plate manufacture or distributor and assembled in quantity by that individual or organization on a conventional production line. In these applications of the invention, the assembling equipment will automatically locate the glass holder in the correct position relative to the plate, making trace 110 unnecessary.

The invention may be embodied in many forms without departing from the spirit or essential characteristics of the invention. The present embodiments are therefore to be considered in all respects as illustrative and not restrictive, the scope of the invention being indicated by the appended claims rather than by the foregoing description; and all changes which come within the meaning and range of equivalency of the claims are therefore intended to be embraced therein.

What is claimed is:

1. A plate-and-glass assembly comprising:

a plate with a food-receiving surface and a lower side;

a glass with a radial rim at an open end thereof; and a glass holder which is a separate component from, and is attached to, the lower side of the plate;

said glass holder and said plate cooperating to allow relative radial sliding displacement of the glass relative to the plate and said glass holder having means so engageable with the rim on the glass as to trap said rim against the lower side of the plate as the glass is radially displaced relative to the plate and thereby so couple said glass to said plate that the mouth of said glass is covered by said plate and said glass is in an upright orientation when said plate is horizontally oriented.

2. A plate-and-glass assembly as defined in claim 1 in which the glass holder has:

a main body portion with a peripheral configuration contoured to complement the peripheral configuration of the lower side of that plate with which the glass holder is intended to be employed;

a channel with a glass-receiving mouth opening onto the periphery of the main body portion, said channel extending radially inward to a closed end so located beyond the center of the main body portion that a glass displaced along the channel to the closed end thereof is centered on the lower side of the plate; and lip means oriented parallel to and spaced from said main body portion along the boundary of said channel for trapping the rim at the open end of the glass against the lower side of the plate to which the glass holder is attached as the glass is displaced relative to the plate through said channel and thereby detachably coupling the glass to the plate.

3. A plate-and-glass assembly as defined in claim 2 in which the glass holder has means for stabilizing the plate to which it is attached on a plate-supporting surface.

4. A plate-and-glass assembly as defined in claim 3 wherein the stabilizing means of the glass holder comprises an integral boss means located to the same side of the main body portion as the rim trapping means, said boss means extending along and being spaced inwardly from the periphery of the main body glass holder portion.

5. A plate-and-glass assembly as defined in claim 2 in which the glass-receiving channel of the glass holder is generally U-shaped and has a rounded closed end and sides which so diverge as they approach the mouth of the channel as to facilitate the entry of the glass into the channel.

6. A plate-and-glass assembly as defined in claim 2 which has means on that side of the glass holder main body portion opposite the rim trapping means for fixing the glass holder to the plate.

7. A plate-and-glass assembly as defined in claim 6 in which the means for fixing the glass holder to the plate is a layer of a pressure sensitive adhesive.

8. A plate-and-glass assembly comprising:

a plate with a food-receiving surface and a lower side;

a glass with a rim at an open end thereof; and a glass holder which cooperates with said plate to allow relative radial sliding displacement of the glass relative to the plate;

said glass holder having means so engageable with the rim on the glass as to trap said rim against the lower side of the plate as the glass is radially displaced relative to the plate and thereby so couple said glass to said plate that the mouth of said glass is covered by said plate and said glass is in an upright orientation; and said assembly also having a further and separate component thereafter engageable with said plate and said glass to lock the glass to the plate.

9. A plate-and-glass assembly as defined in claim 8 in which:

the plate has a straw port; and the means for locking the glass to the plate is a drinking straw extending through the straw port into the glass.

10. A plate-and-glass assembly as defined in claim 9 in which the straw port comprises a food-and liquid-excluding boss protruding upwardly from the food-receiving surface of said plate when the plate is horizontally oriented, there being a drinking straw-receiving bore and aperture extending through the boss and plate and opening onto the upper end of the boss and the lower side of the plate.

11. A plate-and-glass assembly comprising:

a plate with an upper, food-receiving surface and a lower side;

a glass with a radial rim at an open end thereof; and a glass holder which has means cooperating with the lower side of the plate to define a channel through which the rim of the glass can be radially slidingly displaced from the periphery toward the center of the plate;

said channel having a mouth for receiving the rim at the open end of the glass and said glass holder also having means engageable with said rim as to trap the rim against the lower side of the plate as the glass is radially displaced relative to the plate along said channel toward the center of the plate such that the glass holder couples said glass to said plate with the mouth of said glass covered by said plate and said glass in an upright orientation when the plate is horizontally oriented; and here being indicia means on the upper surface of the plate which identifies the location of the mouth of the glass receiving channel.

12. A plate-and-glass assembly as defined in claim 11 in which the indicia means is so provided as to identify that direction of displacement of the glass relative to the plate which will result in the glass being coupled to the plate.

13. A plate-and-glass assembly comprising:

a plate with a food-receiving surface and a lower side;

a glass with a rim at an open end thereof;

a glass holder which cooperates with said plate to allow relative radial sliding displacement of the glass relative to the plate, said glass holder having means so engageable with the rim on the glass as to trap said rim against the lower side of the plate as the glass is radially displaced relative to the plate and thereby couple said glass to said plate with the glass upright and the mouth of the glass covered by said plate when said plate is horizontally oriented; and said assembly further comprising means affording access to the contents of said glass without removal of the glass from the plate.

14. A plate-and-glass assembly as defined in claim 13 in which the means affording access to the contents of the glass comprises a straw port.

15. A plate-and-glass assembly as defined in claim 14 in which the straw port comprises a food-and liquid excluding boss protruding upwardly from the food-receiving surface of said plate when the plate is horizontally oriented, there being a drinking straw-receiving bore and an aperture extending through the boss and the plate and opening onto the upper end of the boss and the lower side of the plate.

16. A glass holder which can be attached to the lower side of a plate to provide a mechanism for detachably coupling a glass to said plate and thereby providing an easily handled plate-and-glass assembly, said glass holder having:

a main body portion with a peripheral configuration contoured to complement the peripheral configuration of the bottom of that plate with which the glass holder is intended to be employed;

a channel with a glass-receiving mouth opening onto the periphery of the main body portion, said channel extending radially inward to a closed end so located beyond the center of the main body portion that a glass radially displaced along the channel to the closed end thereof is centered on the lower side of the plate; and a lip oriented parallel to and spaced from said main body portion and extending along the boundary of said channel for trapping a rim at the open end of a glass against the lower side of a plate to which the glass holder is attached as the glass is radially displaced relative to the plate through said channel, thereby detachably coupling the glass to the plate.

17. A glass holder as defined in claim 16 which has means for stabilizing a plate to which it is attached on a plate-supporting surface.

18. A glass holder as defined in claim 17 wherein the stabilizing means comprises an integral boss means located to the same side of the main body portion as the rim trapping means, said boss means extending along and being spaced inwardly from the periphery of the main body portion.

19. A glass holder as defined in claim 17 in which the glass-receiving channel is generally U-shaped and has a closed end and sides which so diverge as they approach the mouth of the channel as to facilitate the entry of the glass into the channel.

20. A glass holder as defined in claim 16 which has means on that side of the main body portion opposite the rim trapping means for fixing the glass holder to a plate.

21. A glass holder as defined in claim 20 in which the means for fixing the glass holder to the plate is a layer of a pressure sensitive adhesive.

22. A glass holder as defined in claim 21 which has a peel strip on the exposed surface of the layer of pressure sensitive adhesive.

* * * * *